US011399670B1

(12) United States Patent
Orange

(10) Patent No.: US 11,399,670 B1
(45) Date of Patent: Aug. 2, 2022

(54) BACK SCRUBBER DEVICE FOR SHOWERS

(71) Applicant: Nicholas Orange, Charlotte, NC (US)

(72) Inventor: Nicholas Orange, Charlotte, NC (US)

( * ) Notice: Subject to any disclaimer, the term of this patent is extended or adjusted under 35 U.S.C. 154(b) by 255 days.

(21) Appl. No.: 16/735,847

(22) Filed: Jan. 7, 2020

(51) Int. Cl.

| | |
|---|---|
| ***A47K 7/04*** | (2006.01) |
| ***A47K 7/02*** | (2006.01) |
| ***A61H 7/00*** | (2006.01) |
| ***A47K 7/03*** | (2006.01) |

(52) U.S. Cl.
CPC ..... *A47K 7/024* (2013.01); *A47K 7/03* (2013.01); *A47K 7/04* (2013.01); *A61H 7/004* (2013.01); *A46B 2200/1006* (2013.01)

(58) Field of Classification Search
CPC ..... A47K 7/024; A47K 7/03; A47K 7/04
See application file for complete search history.

(56) References Cited

U.S. PATENT DOCUMENTS

| | | | | |
|---|---|---|---|---|
| 4,417,362 | A | 11/1983 | Walker | |
| D409,337 | S | 5/1999 | Johnson, Sr. | |
| 6,996,861 | B1 * | 2/2006 | Clark, Jr. | A47K 7/04 4/606 |
| 7,120,947 | B1 * | 10/2006 | Magallanes | A47K 7/024 4/606 |
| 7,175,357 | B1 | 2/2007 | Brignoni | |
| 7,451,513 | B2 | 11/2008 | Torres | |
| 8,272,799 | B1 * | 9/2012 | Yard | A46B 13/02 401/6 |
| 8,458,840 | B2 | 6/2013 | Sanchez | |
| 9,271,614 | B2 * | 3/2016 | Rowles | A47K 7/024 |
| 2005/0229347 | A1 | 10/2005 | D'Almuano | |
| 2006/0107473 | A1 * | 5/2006 | Torres | A47K 7/024 15/21.1 |
| 2016/0135582 | A1 * | 5/2016 | Yen | A47K 7/04 15/22.1 |
| 2016/0143489 | A1 * | 5/2016 | Grossman | A47K 7/04 4/606 |
| 2017/0332849 | A1 * | 11/2017 | Morris | A47K 7/024 |
| 2019/0174970 | A1 * | 6/2019 | Zohrabian | A47K 7/04 |

FOREIGN PATENT DOCUMENTS

| | | |
|---|---|---|
| EP | 2647323 | 10/2013 |

* cited by examiner

*Primary Examiner* — J C Jacyna

(57) ABSTRACT

The back scrubber device for showers is a therapeutic device. The back scrubber device for showers is configured for use with a patient. The back scrubber device for showers removably attaches to a vertical surface. The back scrubber device for showers comprises a housing and a control circuit. The back scrubber device for showers stores a soap in a liquid phase. The back scrubber device for showers distributes the soap using a plurality of rotating brushes. The back scrubbing device comprises a housing and a control circuit. The housing removably attaches to the vertical surface. The housing contains the control circuit and the soap. The control circuit provides the motive forces to rotate each of the plurality of rotating brushes. The control circuit pumps the soap to the plurality of rotating brushes for distribution through the plurality of rotating brushes.

12 Claims, 7 Drawing Sheets

BACK SCRUBBER DEVICE FOR SHOWERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of brushes and additional arrangements for brushes, more specifically, an electrically enhanced brush. (A46B5/0022)

SUMMARY OF INVENTION

The back scrubber device for showers is a therapeutic device. The back scrubber device for showers is configured for use with a patient. The back scrubber device for showers cleans the back of the patient. The back scrubber device for showers removably attaches to a vertical surface. The back scrubber device for showers comprises a housing and a control circuit. The back scrubber device for showers stores a soap in a liquid phase. The back scrubber device for showers distributes the soap using a plurality of rotating brushes. The back scrubbing device comprises a housing and a control circuit. The housing removably attaches to the vertical surface. The housing contains the control circuit and the soap. The control circuit provides the motive forces to rotate each of the plurality of rotating brushes. The control circuit pumps the soap to the plurality of rotating brushes for distribution through the plurality of rotating brushes.

These together with additional objects, features and advantages of the back scrubber device for showers will be readily apparent to those of ordinary skill in the art upon reading the following detailed description of the presently preferred, but nonetheless illustrative, embodiments when taken n conjunction with the accompanying drawings.

In this respect, before explaining the current embodiments of the back scrubber device for showers in detail, it is to be understood that the back scrubber device for showers is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the back scrubber device for showers.

It is therefore important that the claims be regarded as including such equivalent construction insofar as they do not depart from the spirit and scope of the back scrubber device for showers. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
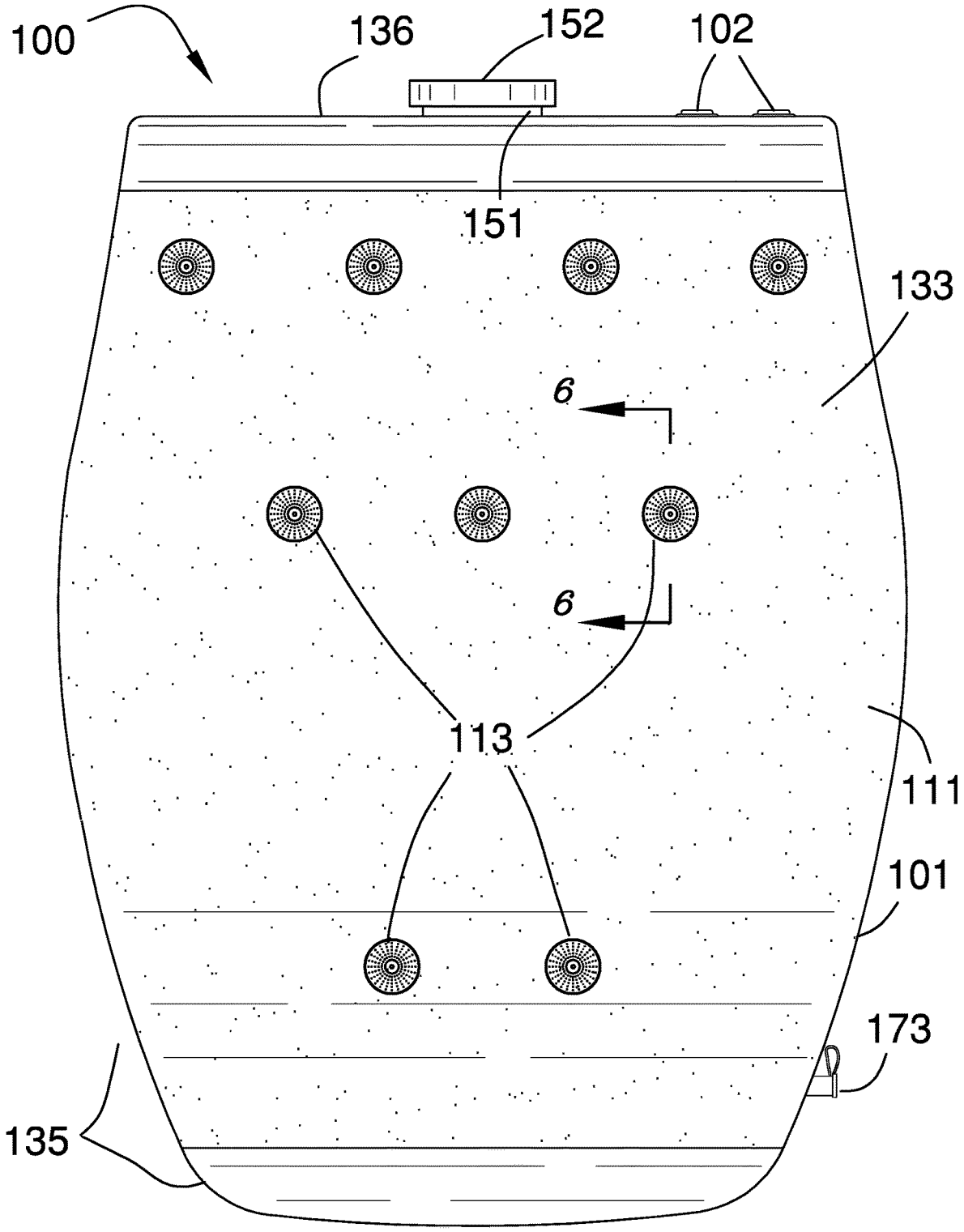
FIG. 1 is a front view of an embodiment of the disclosure.
Figure 2:
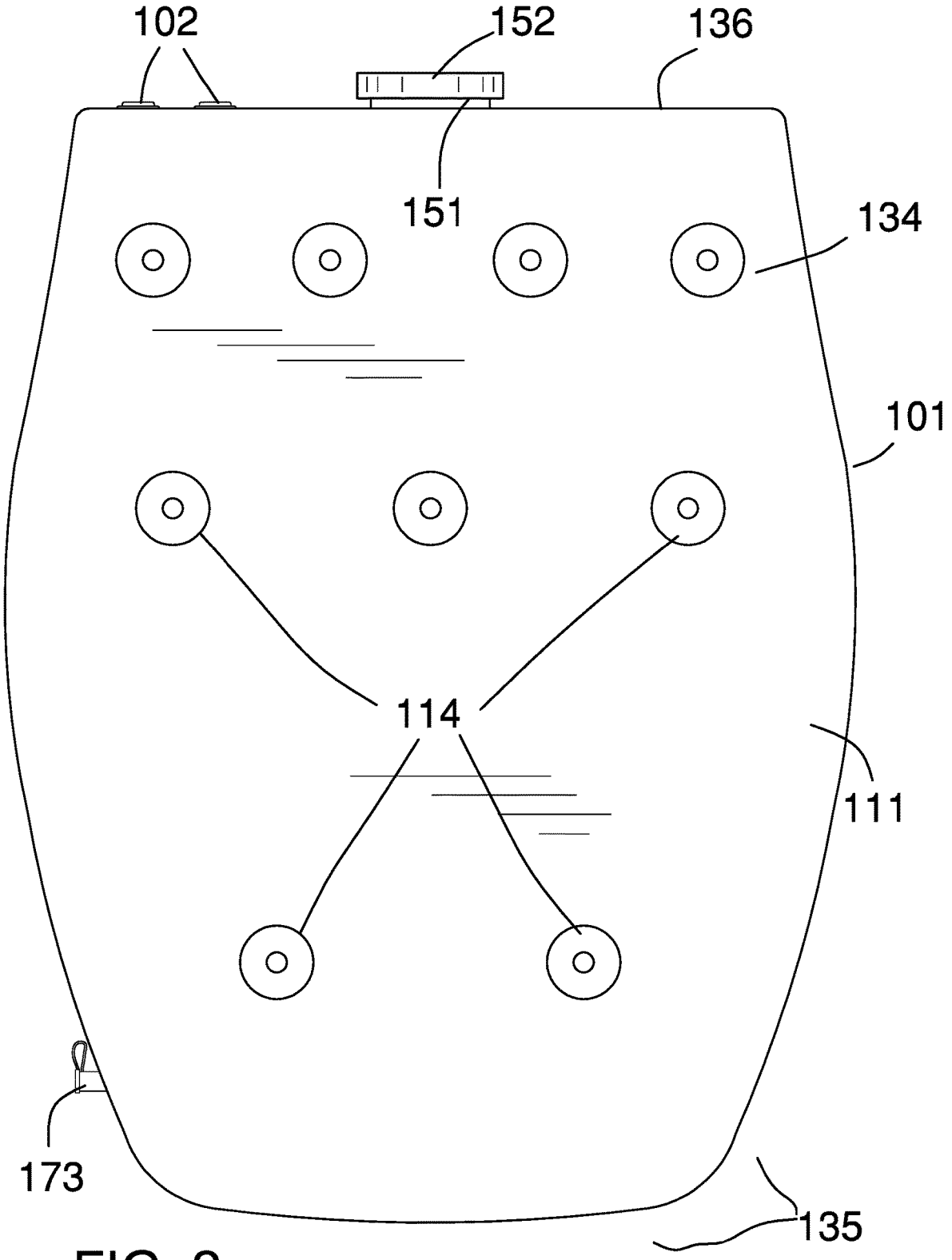
FIG. 2 is a rear view of an embodiment of the disclosure.
Figure 3:
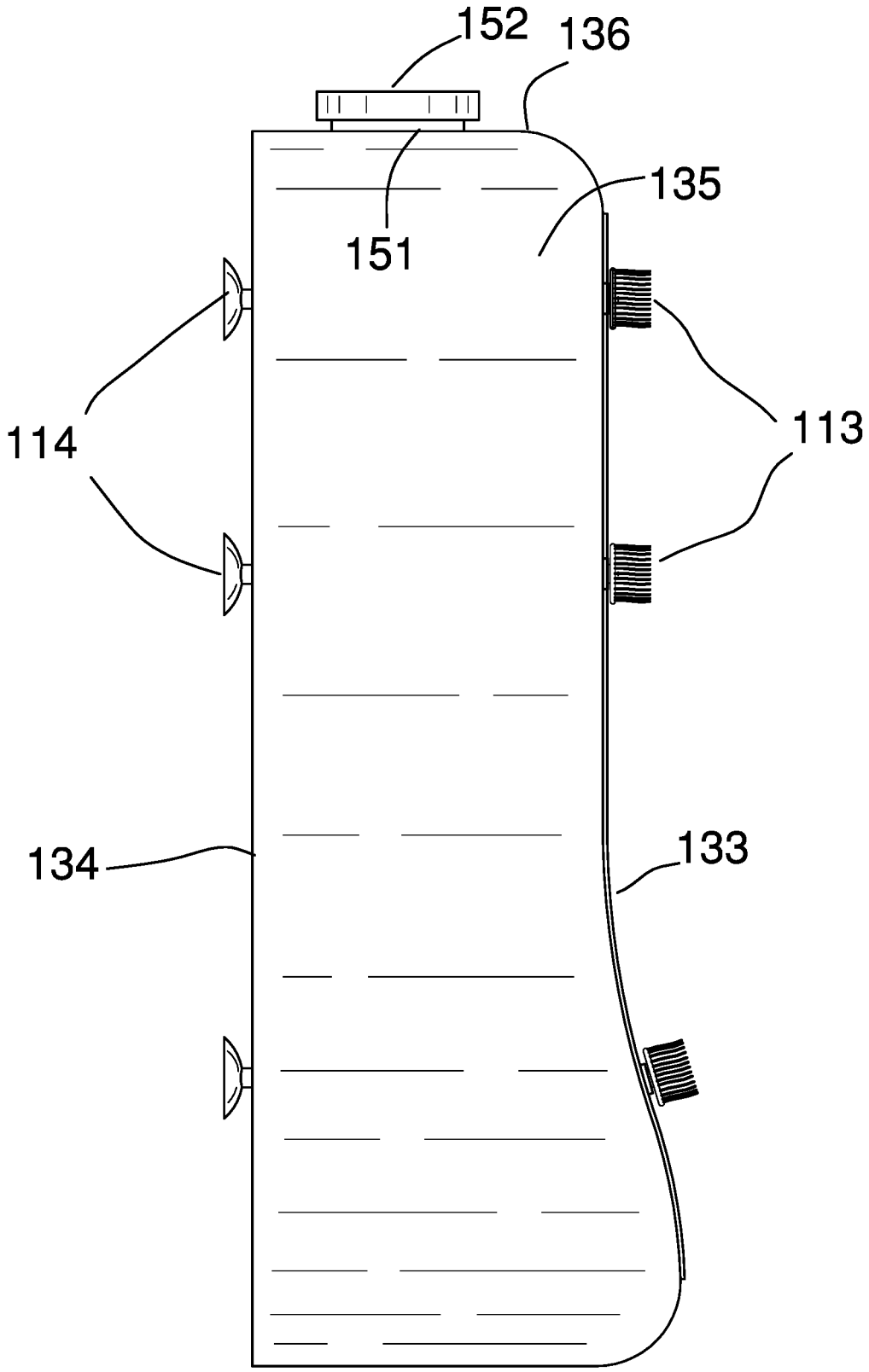
FIG. 3 is a side view of an embodiment of the disclosure.
Figure 4:
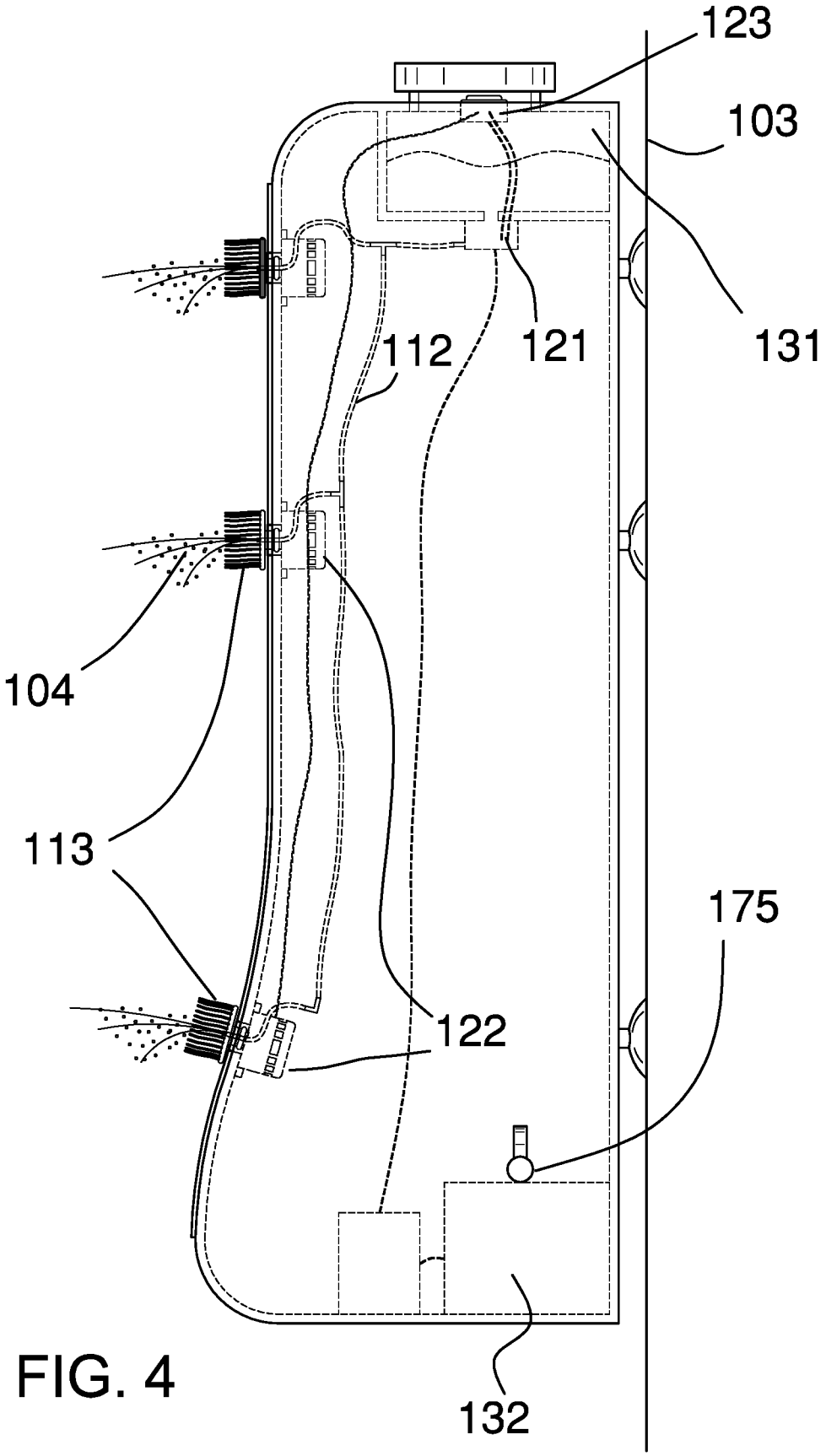
FIG. 4 is a detail view of an embodiment of the disclosure.
Figure 5:
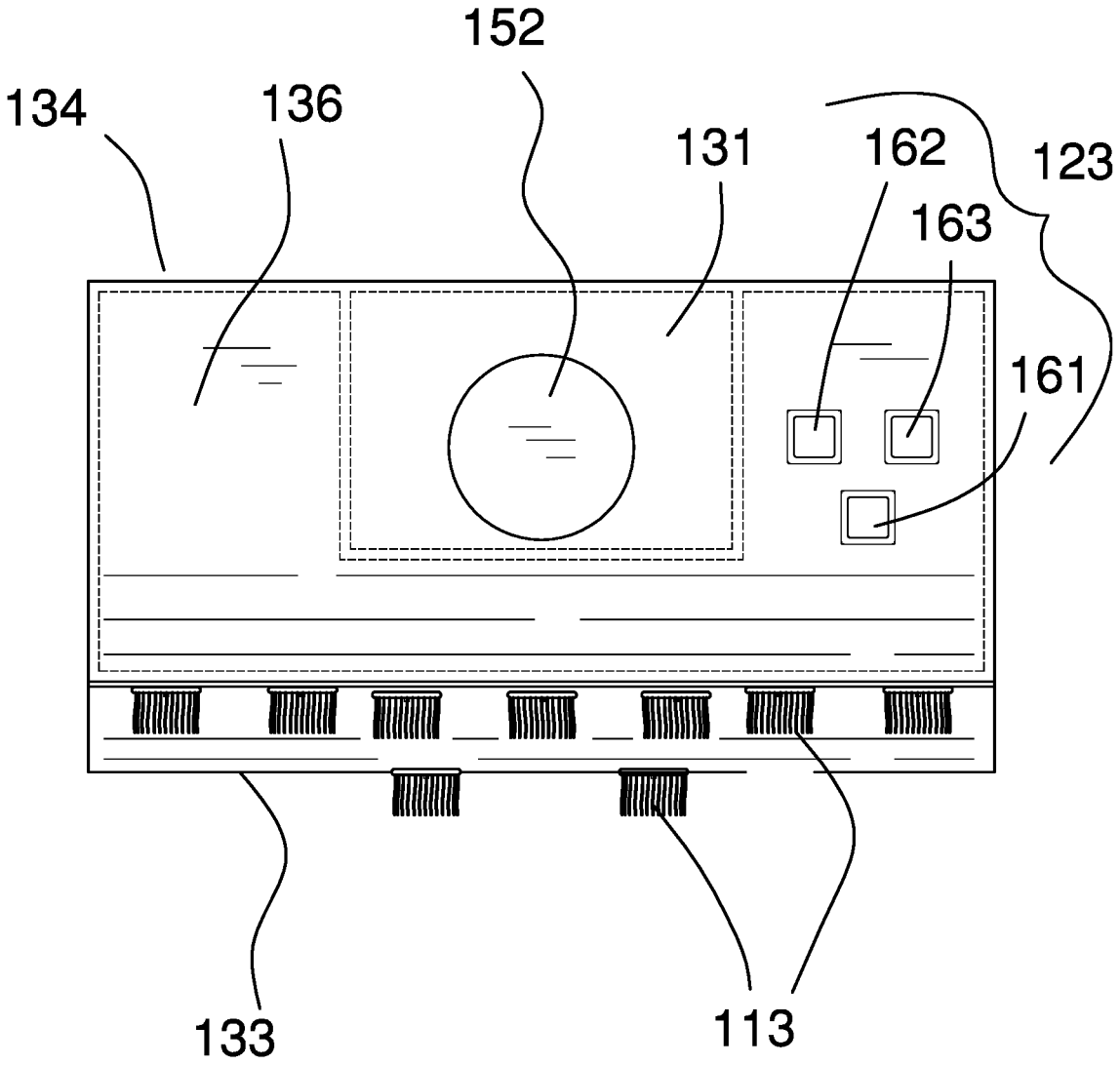
FIG. 5 is a top view of an embodiment of the disclosure.
Figure 6:
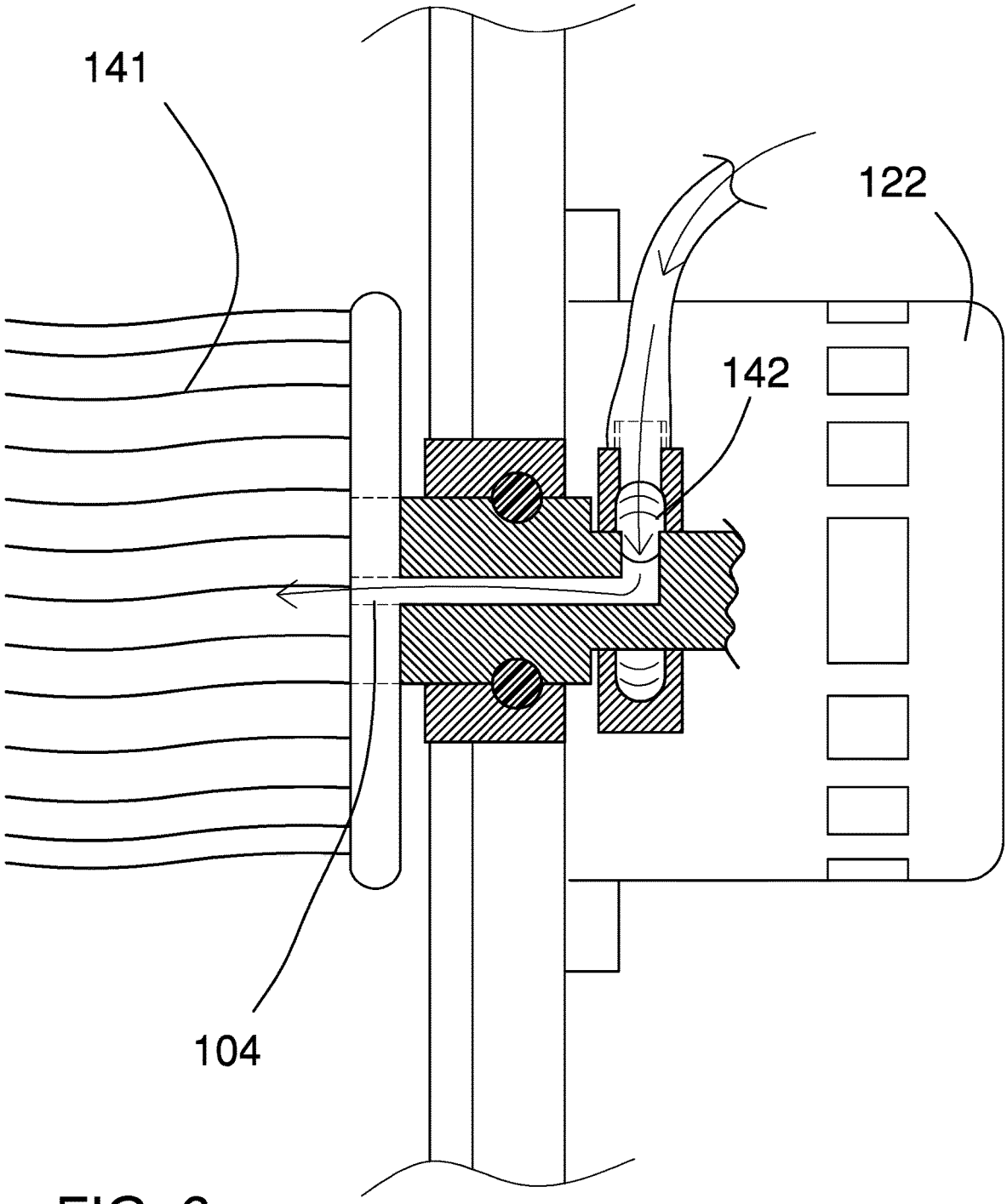
FIG. 6 is a top view of an embodiment of the disclosure.
Figure 7:
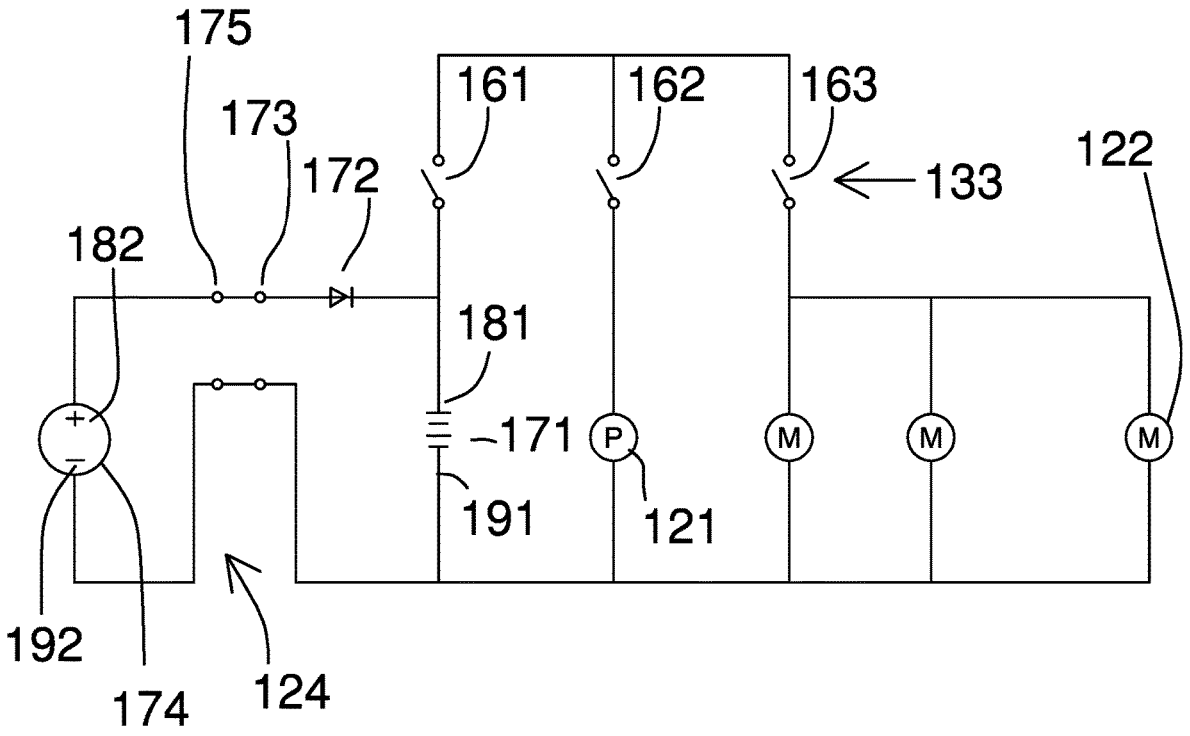
FIG. 7 is a schematic view of an embodiment of the disclosure.

Detailed reference will now be made to one or more potential embodiments of the disclosure, which are illustrated in FIGS. 1 through 7.

The back scrubber device for showers 100 (hereinafter invention) is a therapeutic device. The invention 100 is configured for use with a patient. The invention 100 cleans the back of the patient. The invention 100 removably attaches to a vertical surface 103. The invention 100 comprises a housing 101 and a control circuit 102. The invention 100 stores a soap 104 in a liquid phase. The invention 100 distributes the soap 104 using a plurality of rotating brushes 113. The back scrubbing device comprises a housing 101 and a control circuit 102. The housing 101 removably attaches to the vertical surface 103. The housing 101 contains the control circuit 102 and the soap 104. The control circuit 102 provides the motive forces to rotate each of the plurality of rotating brushes 113. The control circuit 102 pumps the soap 104 to the plurality of rotating brushes 113 for distribution through the plurality of rotating brushes 113.

The vertical surface 103 is a vertically oriented surface on which the housing 101 removably attaches. The soap 104 is a chemical substance used for hygienic purposes. The soap 104 is a liquid phase substance. The soap 104 is defined elsewhere in this disclosure.

The housing 101 is a mechanical structure. The housing 101 contains the soap 104, the plurality of rotating brushes 113, and the control circuit 102. The housing 101 is formed with all apertures and form factors necessary to allow the housing 101 to accommodate the use, the operation, and the external connections of the soap 104 and the control circuit 102. Methods to form a housing 101 suitable for the purposes described in this disclosure are well-known and documented in the mechanical arts. The housing 101 comprises a shell 111, a manifold structure 112, a plurality of rotating brushes 113, and a plurality of suction cups 114.

The shell 111 is a disk-shaped structure. The shell 111 is a rigid structure. The shell 111 contains the control circuit 102, the soap 104 reservoir 131, the circuit pocket 132, the soap 104, and the manifold structure 112. The plurality of rotating brushes 113 and the plurality of suction cups 114 attach to the shell 111. The shell 111 is formed with all apertures and form factors necessary to allow the shell 111 to accommodate the use and operation of the control circuit 102, the soap 104 reservoir 131, the circuit pocket 132, the soap 104, the manifold structure 112, the plurality of rotating brushes 113, and the plurality of suction cups 114. Methods to form a shell 111 suitable for the purposes described in this disclosure are well-known and documented in the mechanical arts.

The shell 111 comprises a soap 104 reservoir 131 and a circuit pocket 132. The shell 111 further comprises an exterior congruent end 133, an interior congruent end 134, and a plurality of lateral faces 135.

The soap 104 reservoir 131 is a segregated containment space formed within the shell 111. The soap 104 reservoir 131 forms a contained fluid impermeable structure that stores the soap 104 within the shell 111. The soap 104 reservoir 131 is formed to allow for the replenishment of the soap 104 contained within the soap 104 reservoir 131. The soap 104 contained in the soap 104 reservoir 131 is physically segregated from the circuit pocket 132. The soap 104 reservoir 131 comprises a feed port 151 and a feed cap 152.

The feed port 151 is a fluid port formed through the shell 111. The feed port 151 provides access into the soap 104 reservoir 131 of the shell 111 that allows for the replenishment of soap 104 into the soap 104 reservoir 131. The feed cap 152 is a lid used to enclose the feed port 151 when the feed port is not in use.

The circuit pocket 132 is a segregated containment space formed within the shell 111. The circuit pocket 132 forms a contained fluid impermeable structure that stores the control circuit 102 within the shell 111. The circuit pocket 132 is physically segregated from the soap 104 contained in the soap 104 reservoir 131.

The exterior congruent end 133 is the congruent end of the disk structure of the shell 111 that is distal from the interior congruent end 134. The plurality of rotating brushes 113 mount on the exterior congruent end 133. The interior congruent end 134 is the congruent end of the disk structure of the shell 111 that is proximal to the vertical surface 103 when the housing 101 attaches properly to the vertical surface 103. The plurality of suction cups 114 mount on the interior congruent end 134. The plurality of lateral faces 135 form the lateral faces of the disk structure of the shell 111.

The plurality of lateral faces 135 form the containment boundaries of the shell 111 between the exterior congruent end and the interior congruent end 134. The plurality of lateral faces 135 further comprises a superior lateral face 136. The superior lateral face 136 is the lateral face selected from the plurality of lateral faces 135 that forms the superior surface of the soap 104 reservoir 131 when the housing 101 attaches properly to the vertical surface 103. The feed port 151 mounts on the superior lateral face 136 of the plurality of lateral faces 135.

The manifold structure 112 forms a fluid network. The manifold structure 112 physically guides the transport of the soap 104 from the soap 104 reservoir 131 to the plurality of rotating brushes 113 where the soap 104 is discharged from the invention 100. The manifold is defined elsewhere in this disclosure.

Each of the plurality of rotating brushes 113 is a brush. Each of the plurality of rotating brushes 113 installs on the exterior congruent end 133 of the shell 111 such that each brush selected from the plurality of rotating brushes 113 is accessible from the exterior of the shell 111. Each of the plurality of rotating brushes 113 is a rotating structure. The rotation of each plurality of rotating brushes 113 creates an abrasive structure used for cleaning the patient. The bristles that form each brush selected from the plurality of rotating brushes 113 physically generate an abrasion used for cleaning. Each of the plurality of rotating brushes 113 is identical. Each of the plurality of rotating brushes 113 further comprises a brush head 141 and a rotating union 142.

The brush head 141 of each rotating brush selected from the plurality of rotating brushes 113 is a bristled brush. The bristled brush is well-known and documented in our society.

Each rotating union 142 is a mechanical device that is associated with the brush head 141 of a rotating brush selected from the plurality of rotating brushes 113. The rotating union 142 is a rotating structure. Each rotating union 142 physically attaches its associated brush head 141 to the brush motor selected from the plurality of brush motors 122 that is associated with the selected rotating brush associated with the brush head 141. The rotating union 142 attaches the selected brush motor to the selected brush head 141 such that the selected brush motor will rotate the selected brush head 141. The rotating union 142 physically attaches its associated brush head 141 to the manifold structure 112 such that the rotating union 142 releases the soap 104 pumped through the manifold structure 112 into the brush head 141 for discharge. Methods to make the rotating union 142 described above are well-known and documented in the mechanical arts. The rotating union 142 is defined elsewhere in this disclosure.

The plurality of suction cups 114 physically attaches the shell 111 to the vertical surface 103. Each of the plurality of suction cups 114 physically attaches to the interior congruent end 134 of the shell 111 such that each brush selected from the plurality of suction cups 114 can physically contact the vertical surface 103. The plurality of suction cups 114 is an apparatus that attaches the shell 111 to the vertical surface 103. Each of the plurality of suction cups 114 is an apparatus that creates a partial vacuum relative to the atmosphere between the surface of the plurality of suction cups 114 and a vertical surface 103. This pressure differential between the partial vacuum and the atmospheric pressure provides the force necessary to secure the shell 111 to the vertical surface 103.

The control circuit 102 is an electric circuit. The control circuit 102 controls the operation of the plurality of rotating brushes 113. The control circuit 102 provides the motive force required to rotate the plurality of rotating brushes 113. The control circuit 102 provides the motive forces required to discharge the soap 104 contained within the housing 101 through the plurality of rotating brushes 113. The control circuit 102 is an independently powered electric circuit. By independently powered is meant that the control circuit 102 can operate without an electrical connection to an external power source 174. The control circuit 102 comprises a pump 121, a plurality of brush motors 122, a plurality of control switches 123, and a power circuit 124. The pump 121, the plurality of brush motors 122, the plurality of control switches 123, and the power circuit 124 are electrically interconnected.

The pump 121 is a mechanical device that generates a pressure differential which is used for transporting the fluid from the soap 104 reservoir 131 through the manifold structure 112 to each of the plurality of rotating brushes 113. An electric motor physically powers the operation of the pump 121. The plurality of control switches 123 controls the operation of the pump 121.

Each of the plurality of brush motors 122 is an electric motor. There is a one to one correspondence between the plurality of brush motors 122 and the plurality of rotating brushes 113. Each of the plurality of brush motors 122 attaches to its corresponding rotating brush selected from the plurality of rotating brushes 113. Each of the plurality of brush motors 122 provides the motive forces necessary to rotate its corresponding rotating brush selected from the plurality of rotating brushes 113.

Each of the plurality of control switches 123 is an electric switch. In the first potential embodiment of the disclosure, each of the plurality of control switches 123 is a maintained switch. The plurality of control switches 123 control the operation of the control circuit 102 by controlling the flow of electricity through the control circuit 102. The plurality of control switches 123 enables the operation of the control circuit 102. The plurality of control switches 123 control the operation of the pump 121. The plurality of control switches 123 control the operation of the plurality of brush motors 122. The plurality of control switches 123 mount on the superior lateral face 136 of the shell 111. The plurality of control switches 123 comprises a master switch 161, a pump 121 switch 162, and a brush switch 163. The plurality of control switches 123 mount on the superior lateral face 136 of the plurality of lateral faces 135.

The master switch 161 is a maintained electric switch. The master switch 161 controls the flow of electricity from the power circuit 124 into the balance of the control circuit 102. The master switch 161 is the power switch of the invention 100.

The pump 121 switch 162 is an electric switch. The pump 121 switch 162 controls the flow of electricity from the master switch 161 into the pump 121. The pump 121 switch 162 controls the operation of the pump 121. In the second potential embodiment of the disclosure, the pump 121 switch 162 is a momentary switch.

The brush switch 163 is a maintained electric switch. The brush switch 163 controls the flow of electricity from the master switch 161 into the plurality of brush motors 122. The brush switch 163 controls the operation of the plurality of brush motors 122.

The power circuit 124 is an electrical circuit. The power circuit 124 powers the operation of the control circuit 102. The power circuit 124 is an electrochemical device. The power circuit 124 converts chemical potential energy into the electrical energy required to power the control circuit 102. The power circuit 124 comprises a battery 171, a diode 172, a charging port 173, and an external power source 174. The external power source 174 further comprises a charging plug 175. The battery 171, a diode 172, a charging port 173, an external power source 174, and the charging plug 175 are electrically interconnected. The battery 171 is further defined with a first positive terminal 181 and a first negative terminal 191. The external power source 174 is further defined with a second positive terminal 182 and a second negative terminal 192.

The battery 171 is an electrochemical device. The battery 171 converts chemical potential energy into the electrical energy used to power the control circuit 102.

The battery 171 is a commercially available rechargeable battery 171. The chemical energy stored within the rechargeable battery 171 is renewed and restored through the use of the charging port 173. The charging port 173 is an electrical circuit that reverses the polarity of the rechargeable battery 171 and provides the energy necessary to reverse the chemical processes that the rechargeable battery 171 initially used to generate the electrical energy. This reversal of the chemical process creates a chemical potential energy that will later be used by the rechargeable battery 171 to generate electricity.

The charging port 173 forms an electrical connection to an external power source 174 using a charging plug 175. The charging plug 175 forms a detachable electrical connection with the charging port 173. The charging port 173 receives electrical energy from the external power source 174 through the charging plug 175. The diode 172 is an electrical device that allows current to flow in only one direction. The diode 172 installs between the rechargeable battery 171 and the charging port 173 such that electricity will not flow from the first positive terminal 181 of the rechargeable battery 171 into the second positive terminal 182 of the external power source 174. In the first potential embodiment of the disclosure, the external power source 174, the charging plug 175, and the charging port 173 are compatible with USB power requirements.

The following definitions were used in this disclosure:

Abrasion: As used in this disclosure, abrasion refers to the rubbing of a first object against a second object in a manner that generates friction.

Battery: As used in this disclosure, a battery is a chemical device consisting of one or more cells, in which chemical energy is converted into electricity and used as a source of power. Batteries are commonly defined with a positive terminal and a negative terminal.

Bristle: As used in this disclosure, a bristle is a short coarse stiff hair or hair like object.

Brush: As used in this disclosure, a brush is a device comprising a plurality of bristles set into a handle or a base that is used for grooming, sweeping, smoothing, scrubbing, or painting.

Cap: As used in this disclosure, a cap is a protective cover that encloses a space or opening.

Carboxylic Acid: As used in this disclosure, a carboxylic acid is an organic molecule that further comprises the carboxyl functional group.

Carboxyl Functional Group: As used in this disclosure, the carboxyl functional group is a functional group with the chemical formula —COOH.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Fatty Acid: As used in this disclosure, a fatty acid refers to a carboxylic acid with a continuous carbon chain of greater than three carbon atoms beyond the carboxyl functional group.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Fluid Network: As used in this disclosure, a fluid network refers to a transport structure that: a) receives a fluid into the fluid network; b) transports the fluid through a series of pipes, valves, and manifold; and, c) discharges the fluid from the fluid network.

Fluid Port: As used in this disclosure, a fluid port is an opening formed in an object that allows fluid to flow through the boundary of the object.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Functional Group: As used in this disclosure, a functional group is a specific chemical structure that 1) defines the structure of a chemical family; and, 2) determines the properties of the chemical family. Common functional groups include, but are not limited to, aldehydes, alkanes, alkenes, alkynes, alcohols, amides, amines, carboxylic acids, esters, ethers, haloalkanes, haloalkenes, haloalkynes, and ketones. As a practical matter, the intention of this definition is to use the term functional group in the same manner as the term is commonly used in organic chemistry.

Hose: As used in this disclosure, a hose is a flexible hollow prism-shaped device that is used for transporting liquids and gases. When referring to a hose in this disclosure, the terms inner dimension and outer dimension are used as they would be used by those skilled in the plumbing arts.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lid: As used in this disclosure, a lid is a removable cover that is placed over an opening of a hollow structure to enclose the hollow structure.

Liquid: As used in this disclosure, a liquid refers to a state (phase) of matter that is fluid and that maintains, for a given pressure, a fixed volume that is independent of the volume of the container.

Maintained Switch: A used in this disclosure, a maintained switch is a switch that maintains the position that was set in the most recent switch actuation. A maintained switch works in an opposite manner to a momentary switch.

Manifold: As used in this disclosure, a manifold is a pipe or chamber having several ports through which one or more fluids are gathered or distributed.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Motor: As used in this disclosure, a motor refers to the method of transferring energy from an external power source into rotational mechanical energy.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Patient: As used in this disclosure, a patient is a person who is designated to receive a medical treatment, therapy or service. The term patient may be extended to an animal when used within the context of the animal receiving veterinary treatment or services.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pump: As used in this disclosure, a pump is a mechanical device that uses suction or pressure to raise or move fluids, compress fluids, or force a fluid into an inflatable object. Within this disclosure, a compressor refers to a pump that is dedicated to compressing a fluid or placing a fluid under pressure.

Reservoir: As used in this disclosure, a reservoir refers to a container or containment system that is configured to store a liquid.

Rigid Structure: As used in this disclosure, a rigid structure is a solid structure formed from an inelastic material that resists changes in shape. A rigid structure will permanently deform as it fails under a force.

Rotary Union: As used in this disclosure, a rotary union is a commercially available plumbing fitting that allows a fluid from a stationary source to be pumped into a rotating structure.

Rotation: As used in this disclosure, rotation refers to the cyclic movement of an object around a fixed point or fixed axis. The verb of rotation is to rotate.

Salt: As used in this disclosure, a salt means an ionic compound that further comprises at least one atom of a metallic element or compound and one atom of a non-metallic element or compound. When dissolved in water, the ionic compound releases the metallic element and the non-metallic element into the water as ions. In this disclosure, a metallic element is assumed to include the alkali metals and the alkali earth metals. Alternatively, and equivalently, a metallic element may be assumed to be any element on the periodic table that is to the left of the metalloids.

Shell: As used in this disclosure, a shell is a structure that forms an outer covering intended to contain an object. Shells are often, but not necessarily, rigid or semi-rigid structures that are intended to protect the object contained within it.

Soap: As used in this disclosure, a soap is a cleansing chemical that is used in cleaning an object. A soap is generally formed from a mixture of one or more salts and one or more fatty acids.

Suction Cup: As used in this disclosure, a suction cup means an object or device that uses negative fluid pressure of air or water to adhere to nonporous surfaces by creating a partial vacuum.

Superior: As used in this disclosure, the term superior refers to a directional reference that is parallel to and in the opposite direction of the force of gravity when an object is positioned or used normally.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Therapeutic: As used in this disclosure, therapeutic is an adjective that refers to a medical, ameliorative, or hygienic substance, process, or procedure.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

USB: As used in this disclosure, USB is an acronym for Universal Serial Bus which is an industry standard that defines the cables, the connectors, the communication protocols and the distribution of power required for interconnections between electronic devices. The USB standard defines several connectors including, but not limited to, USB-A, USB-B, mini-USB, and micro USB connectors. A USB cable refers to a cable that: 1) is terminated with USB connectors; and, 2) that meets the data transmission standards of the USB standard.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A back scrubber device for showers comprising
a housing and a control circuit;
wherein the housing contains the control circuit;
wherein the back scrubbing device is a therapeutic device;
wherein the back scrubber device for showers removably attaches to a vertical surface;
wherein the back scrubber device for showers stores a soap in a liquid phase;

wherein the back scrubber device for showers distributes the soap using a plurality of rotating brushes;

wherein the housing comprises a shell, a manifold structure, the plurality of rotating brushes, and a plurality of suction cups;

wherein the shell comprises a soap reservoir and a circuit pocket;

wherein the shell contains the control circuit, the soap reservoir, the circuit pocket, the soap, and the manifold structure;

wherein the plurality of rotating brushes and the plurality of suction cups attach to the shell;

wherein the control circuit comprises a pump, a plurality of brush motors, a plurality of control switches, and a power circuit;

wherein the pump, the plurality of brush motors, the plurality of control switches, and the power circuit are electrically interconnected;

wherein the power circuit is an electrical circuit;

wherein the power circuit comprises a battery, a diode, a charging port, and an external power source;

wherein the external power source further comprises a charging plug;

wherein the battery, the diode, the charging port, the external power source, and the charging plug are electrically interconnected;

wherein the battery is further defined with a first positive terminal and a first negative terminal;

wherein the external power source is further defined with a second positive terminal and a second negative terminal;

wherein the circuit pocket is a segregated containment space formed within the shell;

wherein the circuit pocket forms a contained fluid impermeable structure that stores the control circuit within the shell;

wherein the circuit pocket is physically segregated from the soap contained in the soap reservoir;

wherein the manifold structure forms a fluid network;

wherein the manifold structure physically guides the transport of the soap from the soap reservoir to the plurality of rotating brushes where the soap is discharged from the back scrubber device for showers;

wherein the rotation of each plurality of rotating brushes creates an abrasive structure used for cleaning the patient;

wherein bristles that form each brush selected from the plurality of rotating brushes physically generate an abrasion used for cleaning;

wherein each of the plurality of rotating brushes is identical.

2. The back scrubber device for showers according to claim 1 wherein the control circuit is an electric circuit;

wherein the control circuit controls the operation of the plurality of rotating brushes;

wherein the control circuit provides the motive force required to rotate the plurality of rotating brushes;

wherein the control circuit provides the motive forces required to discharge the soap contained within the housing through the plurality of rotating brushes;

wherein the control circuit is an independently powered electric circuit;

wherein by independently powered is meant that the control circuit can operate without an electrical connection to an external power source.

3. The back scrubber device for showers according to claim 2 wherein the shell is a disk-shaped structure;

wherein the shell is a rigid structure;

wherein the soap reservoir is a segregated containment space formed within the shell;

wherein the soap reservoir forms a contained fluid impermeable structure that stores the soap within the shell;

wherein the soap reservoir is formed to allow for the replenishment of the soap contained within the soap reservoir.

4. The back scrubber device for showers according to claim 3 wherein the soap reservoir comprises a feed port and a feed cap;

wherein the feed port is a fluid port formed through the shell;

wherein the feed port provides access into the soap reservoir of the shell that allows for the replenishment of soap into the soap reservoir;

wherein the feed cap is a lid used to enclose the feed port.

5. The back scrubber device for showers according to claim 4 wherein each of the plurality of rotating brushes further comprises a brush head and a rotating union;

wherein the brush head of each rotating brush selected from the plurality of rotating brushes is a bristled brush;

wherein each rotating union is a mechanical device that is associated with the brush head of a rotating brush selected from the plurality of rotating brushes;

wherein the rotating union is a rotating structure;

wherein each rotating union physically attaches its associated brush head to the brush motor selected from the plurality of brush motors that is associated with the selected rotating brush associated with the brush head;

wherein the rotating union physically attaches its associated brush head to the manifold structure such that the rotating union releases the soap pumped through the manifold structure into the brush head for discharge.

6. The back scrubber device for showers according to claim 5 wherein the plurality of suction cups physically attaches the shell to the vertical surface;

wherein the plurality of suction cups is an apparatus that attaches the shell to the vertical surface;

wherein each of the plurality of suction cups is an apparatus that creates a partial vacuum relative to the atmosphere between the surface of the plurality of suction cups and the vertical surface.

7. The back scrubber device for showers according to claim 6 wherein the shell further comprises an exterior congruent end, an interior congruent end, and a plurality of lateral faces;

wherein the exterior congruent end is the congruent end of the disk structure of the shell that is distal from the interior congruent end;

wherein the plurality of rotating brushes mount on the exterior congruent end;

wherein the interior congruent end is the congruent end of the disk structure of the shell that is proximal to the vertical surface when the housing attaches properly to the vertical surface;

wherein the plurality of suction cups mount on the interior congruent end;

wherein the plurality of lateral faces form the lateral faces of the disk structure of the shell;

wherein the plurality of lateral faces form the containment boundaries of the shell between the exterior congruent end and the interior congruent end;

wherein the plurality of lateral faces further comprises a superior lateral face;

wherein the superior lateral face is the lateral face selected from the plurality of lateral faces that forms the superior surface of the soap reservoir when the housing attaches properly to the vertical surface;

wherein the feed port mounts on the superior lateral face of the plurality of lateral faces;

wherein each of the plurality of rotating brushes installs on the exterior congruent end of the shell such that each brush selected from the plurality of rotating brushes is accessible from the exterior of the shell;

wherein each of the plurality of suction cups physically attaches to the interior congruent end of the shell.

8. The back scrubber device for showers according to claim 7 wherein the pump is a mechanical device that generates a pressure differential which is used for transporting the fluid from the soap reservoir through the manifold structure to each of the plurality of rotating brushes;

wherein an electric motor physically powers the operation of the pump;

wherein the plurality of control switches controls the operation of the pump.

9. The back scrubber device for showers according to claim 8 wherein each of the plurality of brush motors is an electric motor;

wherein there is a one to one correspondence between the plurality of brush motors and the plurality of rotating brushes;

wherein each of the plurality of brush motors attaches to its corresponding rotating brush selected from the plurality of rotating brushes;

wherein each of the plurality of brush motors provides the motive forces necessary to rotate its corresponding rotating brush selected from the plurality of rotating brushes;

wherein the rotating union attaches a selected brush motor to a selected brush head such that the selected brush motor will rotate the selected brush head.

10. The back scrubber device for showers according to claim 9 wherein each of the plurality of control switches is an electric switch;

wherein each of the plurality of control switches is a maintained switch;

wherein the plurality of control switches control the operation of the control circuit by controlling the flow of electricity through the control circuit;

wherein the plurality of control switches enables the operation of the control circuit;

wherein the plurality of control switches control the operation of the pump;

wherein the plurality of control switches control the operation of the plurality of brush motors;

wherein the plurality of control switches mount on the superior lateral face of the shell.

11. The back scrubber device for showers according to claim 10 wherein the battery is a rechargeable battery;

wherein the chemical energy stored within the rechargeable battery is renewed and restored through the use of the charging port;

wherein the charging port is an electrical circuit that reverses the polarity of the rechargeable battery and provides the energy necessary to reverse the chemical processes that the rechargeable battery initially used to generate the electrical energy;

wherein the charging port forms an electrical connection to an external power source using a charging plug;

wherein the charging plug forms a detachable electrical connection with the charging port;

wherein the charging port receives electrical energy from the external power source through the charging plug;

wherein the diode is an electrical device that allows current to flow in only one direction;

wherein the diode installs between the rechargeable battery and the charging port such that electricity will not flow from the first positive terminal of the rechargeable battery into the second positive terminal of the external power source.

12. The back scrubber device for showers according to claim 11 wherein the plurality of control switches comprises a master switch, a pump switch, and a brush switch;

wherein the master switch controls the flow of electricity from the power circuit into the balance of the control circuit;

wherein the pump switch controls the flow of electricity from the master switch into the pump;

wherein the pump switch controls the operation of the pump;

wherein the brush switch controls the flow of electricity from the master switch into the plurality of brush motors;

wherein the brush switch controls the operation of the plurality of brush motors.

* * * * *